United States Patent [19]

Fay et al.

[11] 4,062,765

[45] Dec. 13, 1977

[54] APPARATUS AND PROCESS FOR THE SEPARATION OF PARTICLES OF DIFFERENT DENSITY WITH MAGNETIC FLUIDS

[75] Inventors: Homer Fay, Katonah; Jean Marie Quets; Henri Hatwell, both of White Plains, all of N.Y.

[73] Assignee: Union Carbide Corporation, New York, N.Y.

[21] Appl. No.: 645,016

[22] Filed: Dec. 29, 1975

[51] Int. Cl.[2] ..... B03B 5/30

[52] U.S. Cl. ..... 209/1; 209/172.5; 210/425

[58] Field of Search ..... 209/1, 223 R, 172.5, 209/232; 210/42, 222, 223, DIG. 26 P; 335/49, 51; 308/10; 252/62.51, 62.52

[56] References Cited

U.S. PATENT DOCUMENTS

| | | | |
|---|---|---|---|
| 2,919,803 | 1/1960 | Stem | 209/223 R |
| 3,374,037 | 3/1968 | Weinberger | 308/10 |
| 3,483,968 | 12/1969 | Kaiser | 209/1 |
| 3,483,969 | 12/1969 | Rosensweig | 209/1 |
| 3,657,119 | 4/1972 | Turbeville | 210/DIG. 26 P |
| 3,951,784 | 4/1976 | Kaiser | 209/1 |

FOREIGN PATENT DOCUMENTS

| | | | |
|---|---|---|---|
| 45-7117 | 4/1966 | Japan | 210/222 |
| 816,974 | 7/1959 | United Kingdom | 210/222 |

OTHER PUBLICATIONS

Chem. Abst., 80, 1974, 85872k.

*Primary Examiner*—Robert Halper
*Attorney, Agent, or Firm*—Richard G. Miller

[57] ABSTRACT

Separation of a mixture of non-magnetic particles on the basis of their different densities is accomplished by levitation in a magnetic fluid using a multiplicity of magnetic gaps created by a grid of magnetic poles oriented with respect to each other such that the polarity of the magnetic field generated in each gap is opposite to that of each adjacent gap.

10 Claims, 8 Drawing Figures

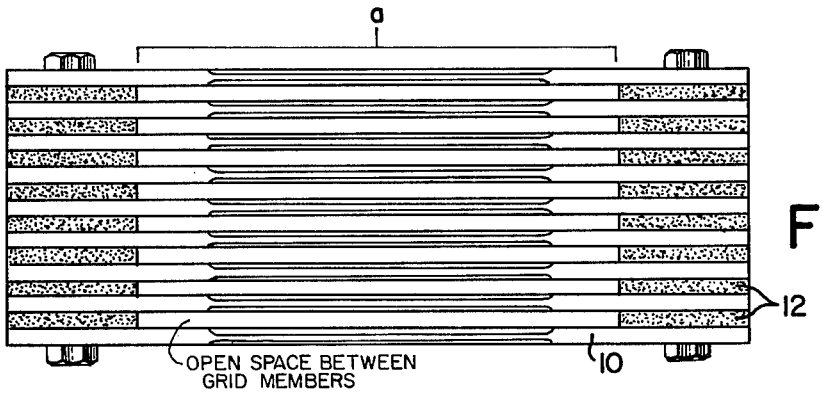
FIG. 1A
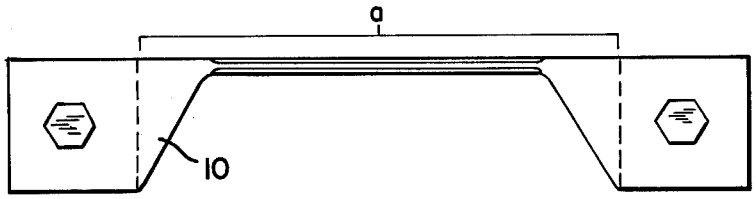
FIG. 1B
FIG. 2
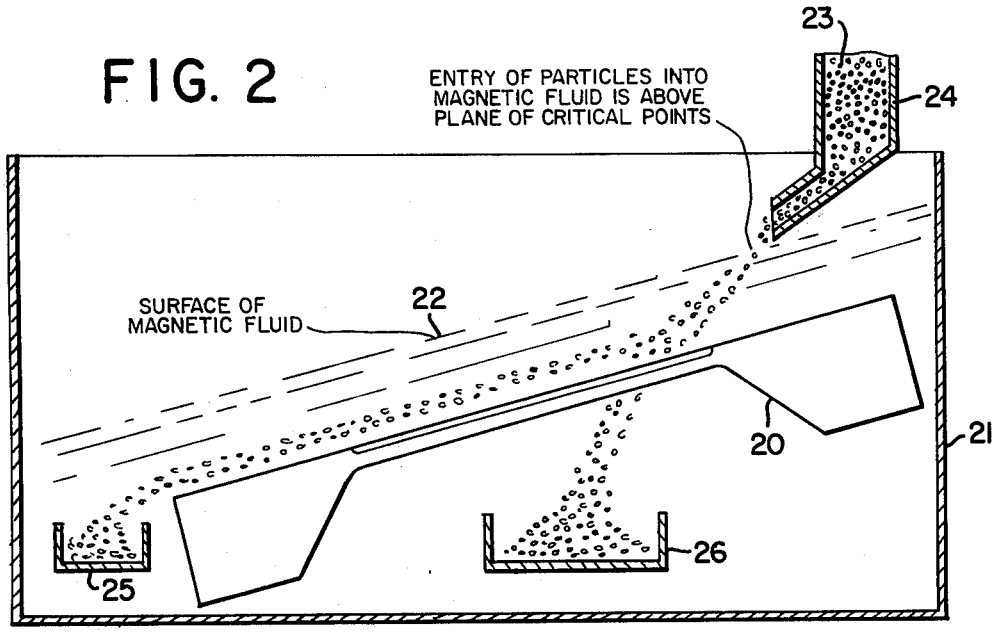

COUNTOUR MAP OF VERTICAL FORCES, FIVE WIRES OF LARGE ARRAY

APPARATUS AND PROCESS FOR THE SEPARATION OF PARTICLES OF DIFFERENT DENSITY WITH MAGNETIC FLUIDS

The present invention relates in general to the separation of mixtures of solid particles into fractions based on differences in the density of the various particles involved. More particularly, the invention relates to the separation of particles by ferrohydrodynamic processes in which the separation locus in the magnetic medium employed is a two-dimensional area of uniform magnetic gradient which functions as a density separator. The invention also relates to novel apparatus suitable for carrying out the aforesaid processes.

The principles that only recently have been utilized in density separation processes using magnetic fluids were elucidated many years ago. In general terms the processes involve introducing a mixture of particles of at least two substances having different densities into a fluid medium having strongly paramagnetic or superparamagnetic properties, and imposing an inhomogeneous magnetic field on the system. Although under the influence of the magnetic field the magnetic fluid exhibits a number of behaviorial aspects not characteristic of normal fluids, the significant effect, insofar as the density separation process is concerned is an additional non-uniform pressure equivalent to the magnetic energy density that is created in the fluid. This pressure exerts, on the particles introduced, a net force, independent of the density of the particles, in a direction opposite to the gradient of the magnitude of the imposed magnetic field. By applying the magnetic field in such a manner that the force on the particles is opposed to the force of gravity thereon, a buoyancy can be created for dense particles which is directly related to their density. Thus, of the particles placed in the magnetic fluid, those of the higher density can be made to "sink" and those of lesser density can be made to "float". Once the particles are segregated in the fluid by virtue of their density values a variety of mechanical means can be used to isolate the various segregated portions of particles from the system.

The separation of mixed particles on the basis of their respective densities by magnetic levitation has more recently been proposed using as the magnetic fluid a stable colloidal suspension of superparamagnetic particles in such liquid media as kerosene, xylene, silicone oil, fluorocarbons, organic esters and water. A procedure of this type is disclosed in U.S. Pat. No. 3,483,969 issued Dec. 16, 1969 to R. E. Rosensweig. Superparamagnetic materials are highly magnetizable in a magnetic field, but do not retain their magnetism when the field is removed. There is accordingly no hysteresis loop in their magnetization curves. The most common superparamagnetic substances are iron, the iron oxide $Fe_3O_4$ (magnetite), cobalt and nickel each being in a finely divided state. Additionally, some rare earth compounds, certain alloys of platinum and rhenium as well as aqueous solutions of manganese salts have also been used to form magnetic fluids. Of these materials iron has by far the highest magnetic susceptibility.

Various processes for separating materials of different density by the difference in levitating forces in the aforesaid superparamagnetic fluids have been disclosed. U.S. Pats. on process and apparatus relating to the separation of particles by this approach are No. 3,483,969 of Dec. 16, 1969 and No. 3,488,531 of Jan. 6, 1970 to Rosensweig, No 3,483,968 of Dec. 16, 1969 to Kaiser, and No. 3,788,465 of Jan. 29, 1974 to Reimers et al. In all these prior disclosures, however, the magnetic fluid has been held in the gap of a comparatively large magnet and perforce the particles to be separated must flow through this single magnetized gap. Necessarily the size of the single gap is limited by the size of the magnet. To date the largest apparatus for a particle separation purpose which has been constructed is described in NASA Report CR-132318 of June 28, 1972. The apparatus has a separating zone eight inches on each side, a magnetic gradient of 250 oersteds per cm., and creates an apparent density of 8 gm./cm$^3$. The magnet used in that apparatus is an electromagnet drawing 10 kilowatts at an apparent density of 8, with C-shaped yoke, hyperbolic poles, dimensions of 21 by 16 by 16 inches containing 10,500 pounds (4,760 kg) of steel and 1,340 pounds (610 kg) of copper wire. The magnetic gradient in this magnet was uniform to ± 10%. In this single-gap type of apparatus, objects to be separated are fed into the central region of magnetic fluid in the enclosed gap and separated into sink and float fractions by the magnetic forces described above. Conveyor belts remove the high density and low density fractions separately. Scale-up of a single gap involves construction of ever larger, ever more costly, and ever more power-hungry electromagnets. Also, all the material to be processed flows through a single region where any problem in agglomeration or any conveyor problem jams up the entire operation. For the single-gap separator of the prior art, these problems are intensified for fine particles, i.e. smaller than about five millimeters. Due to flow resistancein the magnetic liquid, as well as ease in jamming conveyor belts, fine particles are most difficult for single-gap separators to process. The practical lower limit for this type of apparatus has been about one-quarter inch (one-half centimeter). Many valuable materials can be liberated for separation only by crushing or grinding into granules or fine powders, which the instant invention is designed to handle.

Thus a principal objective of the instant invention is to provide a process which utilizes magnetic fluids in separating nonmagnetic objects without the need for large high-powered, heavy, and costly electromagnets for generating and maintaining the requisite magnetic fields and magnetic field gradients. Another objective is to provide a process and apparatus capable of separating small particles of from about 5 mm. down to one micrometer in diameter by their density. Still another objective is to provide separating equipment compatible with other materials handling equipment such as crushers, grinders, mills, magnetic separators, conveyors, and the like.

In the drawings:

FIG. 1*a* is a top view of a magnetic grid suitable for a filter-type separation of particles of differing densities.

FIG. 1*b* is a side view of the magnetic grid shown in FIG. 1*a*.

FIG. 2 is a cross-sectional side view of the grid of FIG. 1*a* in combination with a levitation tank and conveying means to accomplish a separation and collection of particles of different densities.

Figure 3:
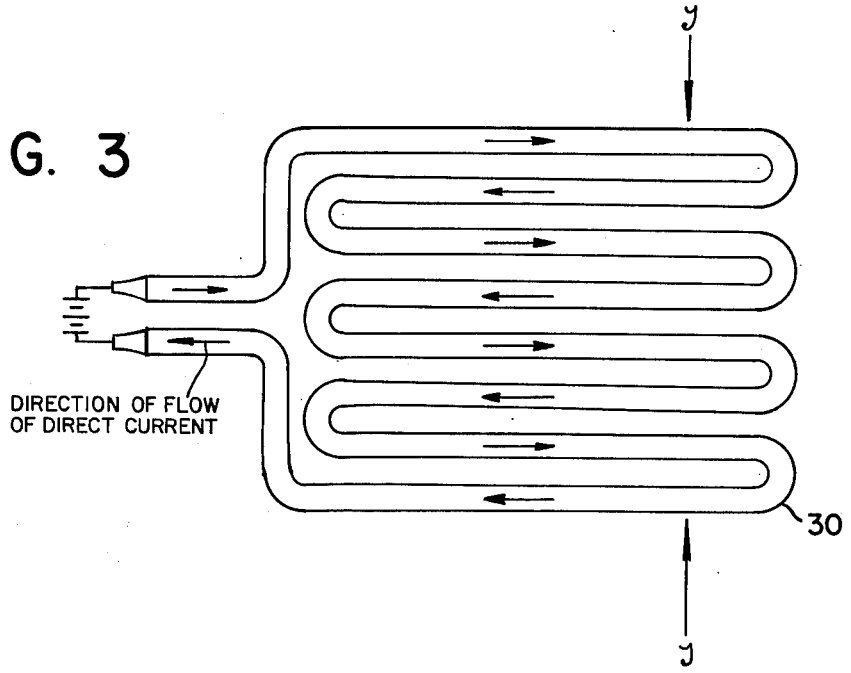
FIG. 3 is a top view of a grid device formed from a continuous electrical conductor.
Figure 3A:
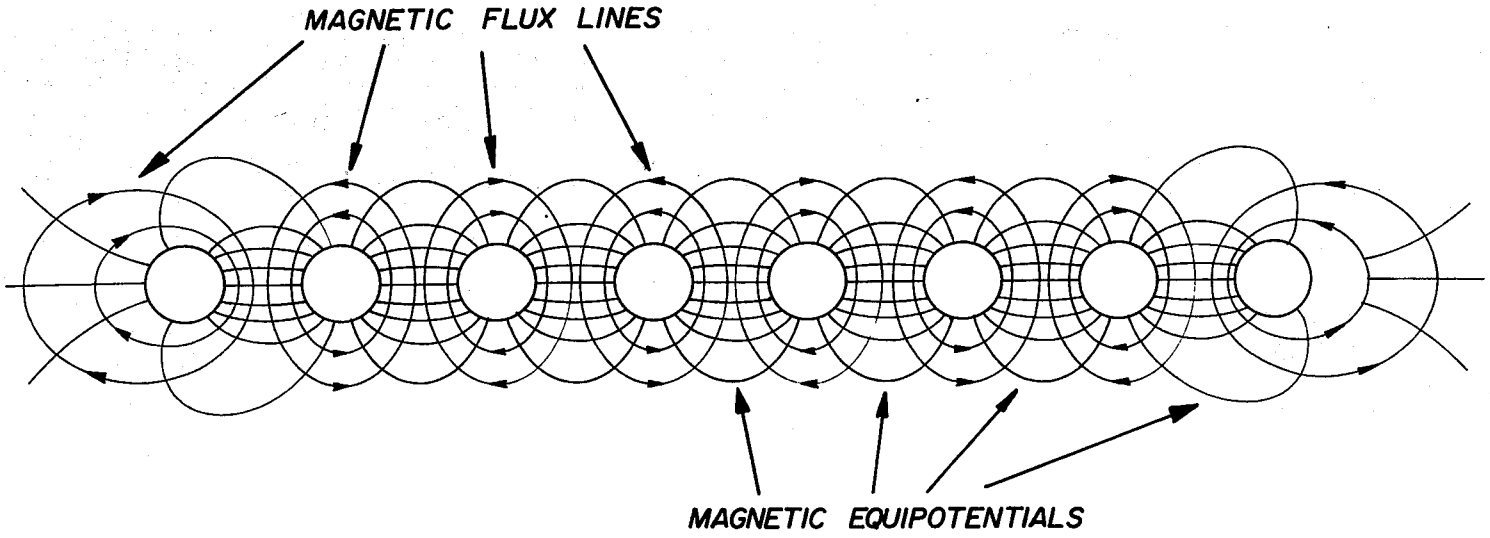

FIG. 3*a* is a magnified cross-sectional right-to-left end view of the grid shown in FIG. 3 taken along line y—y.

Figure 4:
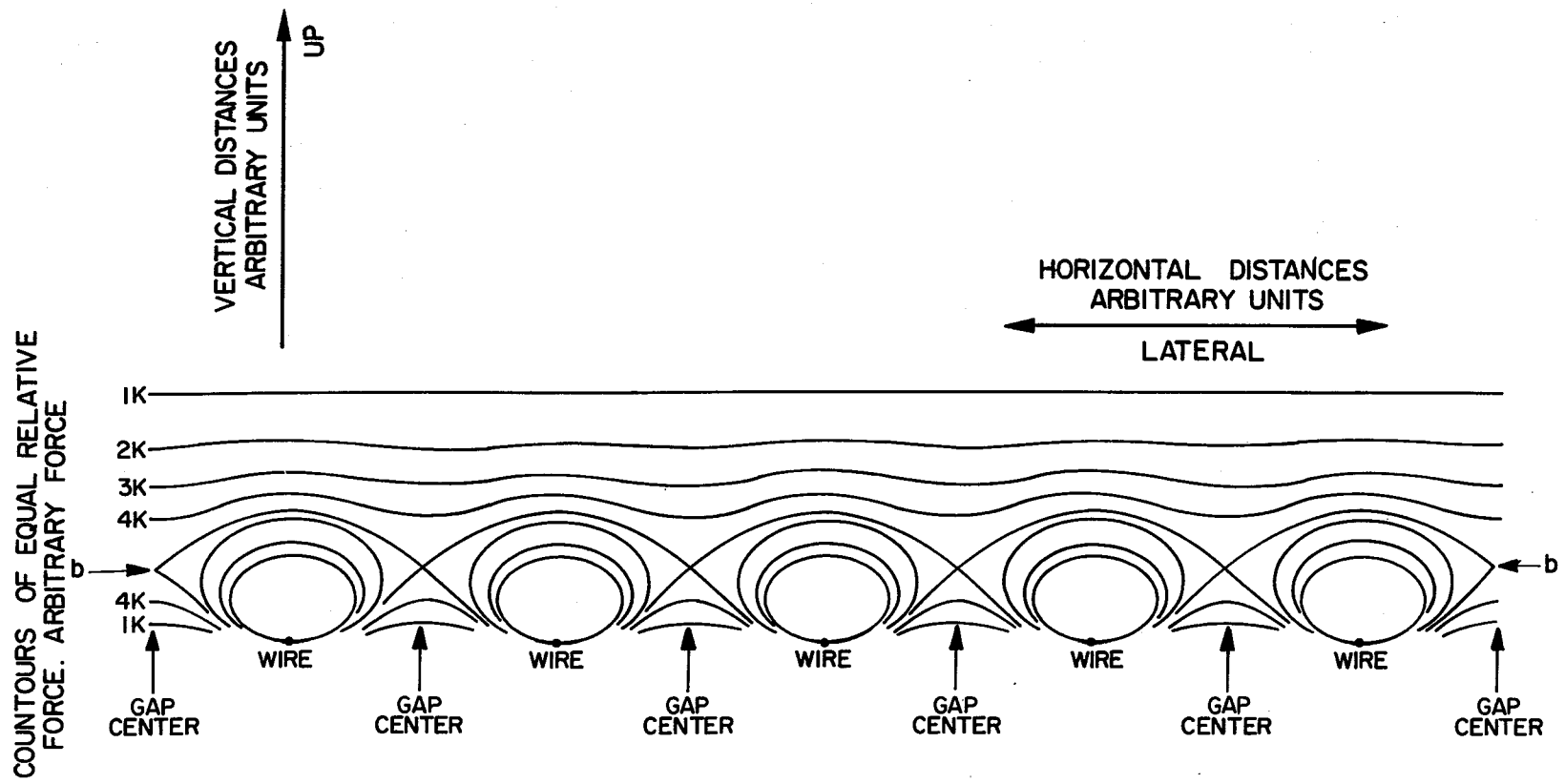

FIG. 4 is a contour map of the vertical component of the field gradient in a magnetic fluid produced by a wire grid apparatus.

Figure 5:
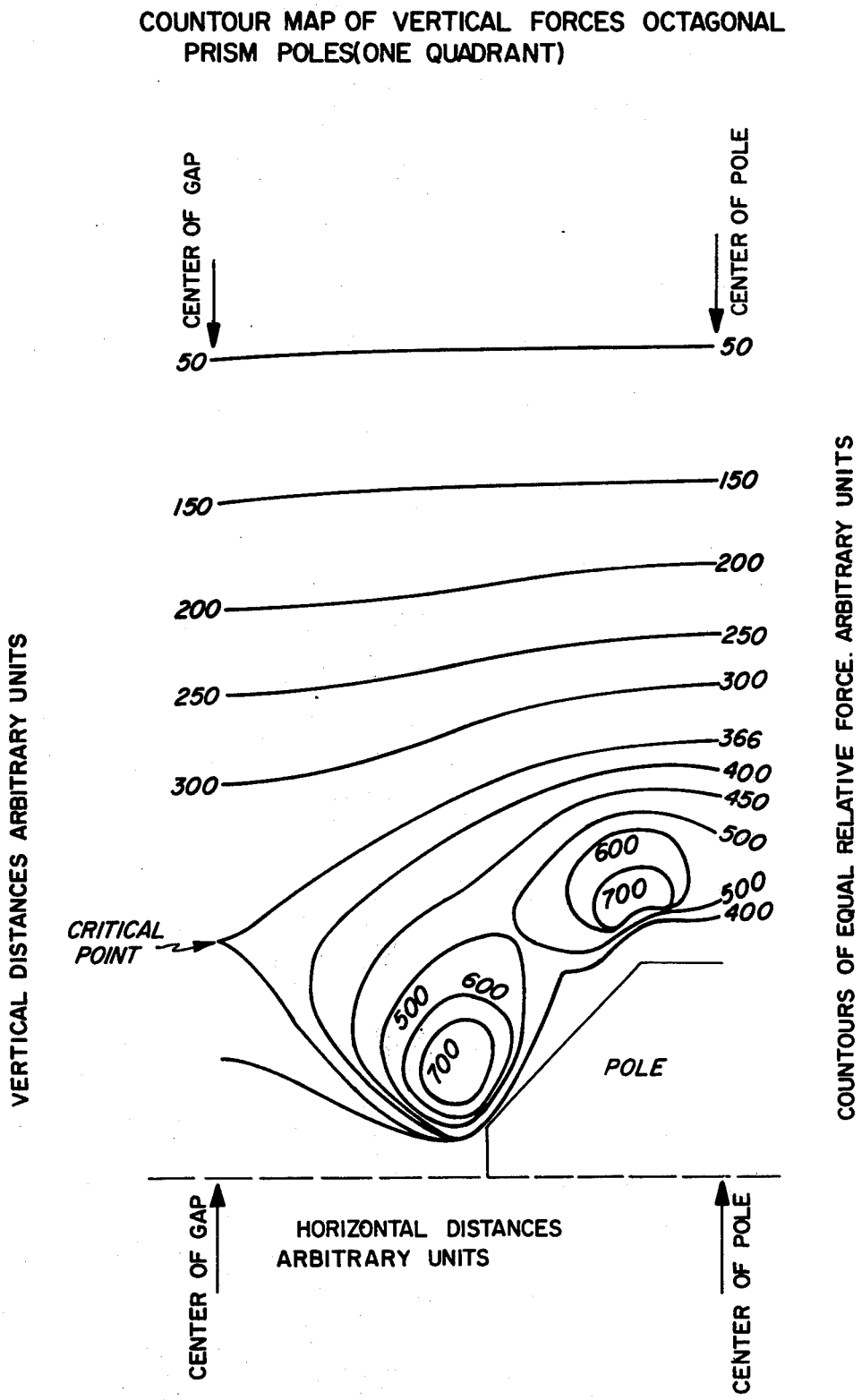

FIG. 5 is a contour map of the vertical component of one quadrant of the field gradient produced in a magnetic fluid by an octagonal grid member of an apparatus of the present invention.

Figure 6:
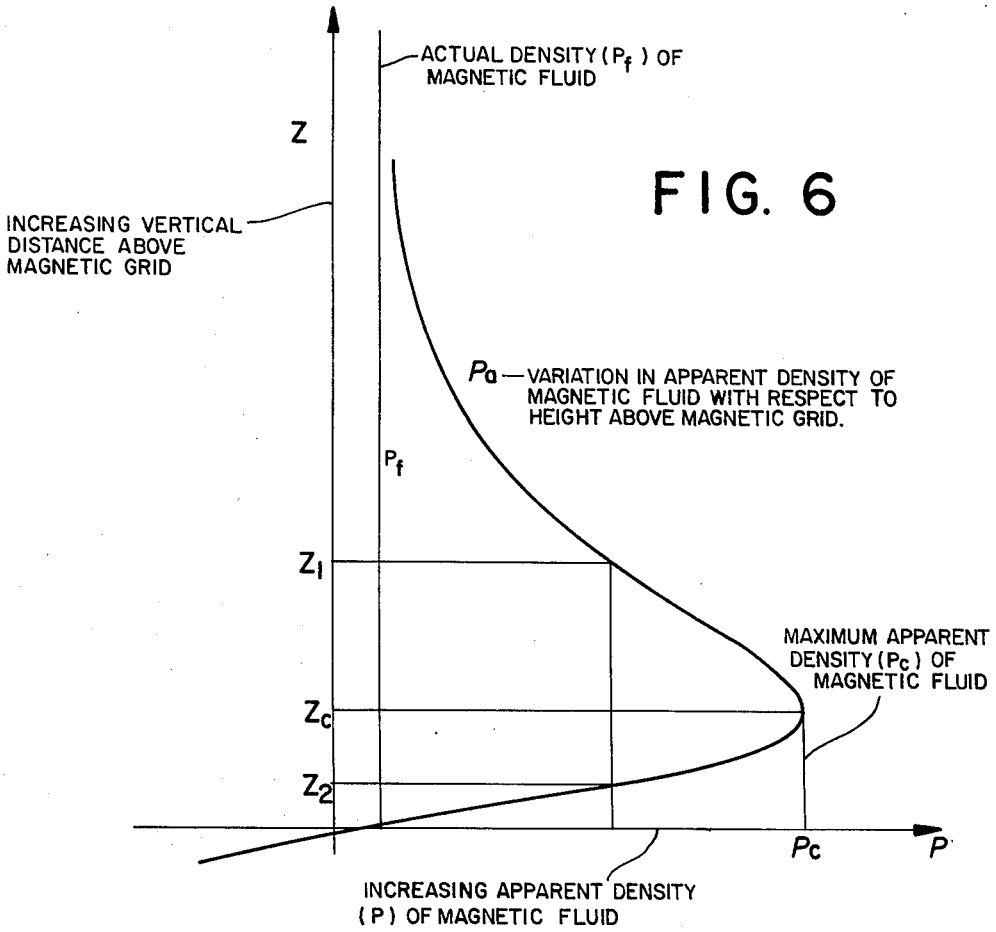

FIG. 6 is a graphic profile of the apparent density produced in a magnetic fluid by a typical magnetic grid device.

In accomplishing the general objectives set forth above, it has been found that one can utilize a phenomenon observed when an essentially planar grid of a plurality of magnetic gaps is placed in or closely adjacent to a ferromagnetic fluid medium. Basically, the magnetic grid structures involved are arrays of magnetic poles and gaps, each defining a region of magnetic field intensity and magnetic flux density according to the laws of magnetostatics. Unlike the single-gap structures of the prior art in which the magnetic fluid is confined between and influenced by emanations from a single pair of poles, the magnetic grid of the present invention, which can be entirely surrounded by the magnetic fluid, exerts a plurality of magnetic forces on the magnetic fluid. These forces are interacting and complex, with the result that neither the field intensity nor the gradient is uniform over any large region of the fluid, but nevertheless, large local values of $\nabla H$ are created in the vicinity of the grid structure that cause forces on non-magnetic particles according to the equation.

$$F_m = V(I_o - I_f)\nabla H \quad (1)$$

wherein $V$ represents the volume of the particle in cubic meters, $I_o$ and $I_f$ is the magnetic intensity of the particle and the magnetic fluid, respectively, in Teslas, and H represents the gradient of the magnitude of the magnetic field, a vector quantity, in amperes per square meter.

It is further found that when a repetitive grid structure, i.e., one having gaps and poles in uniform planar configuration and strength, is placed horizontally in or immediately beneath a magnetic fluid mass, the gradient, in general, produces both vertical and horizontal forces. The horizontal forces, however, are negligible at heights above the grid that are greater than about one-half the grid spacing. With respect to the vertical component of the gradient, it is observed that the contours of constant force thereof are of two distinct types. In the close vicinity of the grid poles the contours of constant vertical force map as discontinuous surfaces with respect to the overall grid surface. At greater distances from the grid poles, the constant vertical forces map as continuous surfaces. The transition boundry between the continuous and discontinuous contours is a complex surface. This surface contains a plurality of points in a plane parallel to the major grid surface, defined by the plurality of points which locate the highest vertical force values on vertical mid-planes between the poles. These points are "critical points" and the value of the vertical force (normal to the plane of the grid) at such points is termed the "critical value." The continuous sheets or surfaces of constant vertical force contours above the critical points form a barrier to the passage through the grid spaces of particles of low density while permitting the passage therethrough of high density particles. The system, therefore, can operate as a filler type separator for making local binary separations of particles based on density. By cascading or stacking a number of grids tuned to different densities, a number of density fractions can be obtained — each grid making a binary local separation.

At or above the critical point in the system described above, the same decrease occurs in the vertical component of the gradient with increasing height above the grid as is exhibited in conventional single pole levitation apparatus. Accordingly, a multiple gap grid need not be used only as a filter type separator, in which the more dense particles are separated by virtue of having dropped below the transition boundary between the continuous and discontinuous contours, but can also be used to separate particles of different densities entirely within the continuous contours zone of the magnetic fluid. A combination of the two types of separation processes is also readily accomplished using a multiple gap grid apparatus of the present invention. The unique capabilities of the multiple-gap grid, however, can be readily appreciated from a consideration of the effects the size of the particles to be separated have on attempts to scale-up, i.e., increase the capacity of the magnetic grid apparatus vis-a-vis a single gap type of apparatus.

The invention has been described hereinabove with reference to a horizontally situated grid. It has been found, however, that tilting the grid is in some instances advantageous since it permits the use of gravitational force to transport the particles over the grid. In this embodiment the forces that act on a non-magnetic particle operate in a direction normal to the surface of the grid as in the case of the horizontally situated grid, but now the forces are no longer vertical. These forces serve as a barrier for low density particles, whereas high density particles can fall below the critical point. The low density particles are not stationary but can continue to move through, or along with, the magnetic fluid in a direction substantially parallel with the surface of the grid structure.

It is convenient to compare different processes according to the force per volume of the particle, F/V. If the particle is considered to be a sphere, then $V = (4/3)n\ r^3$. For a non-magnetic particle in a magnetic fluid, the applicable equations are:

$$F_m/V = I_f \nabla H \quad (2)$$

$$F_g/V = (P_o - P_f)g \quad (3)$$

$$F_s/V = (9/2)nv/r^2 \quad (4)$$

$$F_n/V = (\tfrac{3}{8})Qp_f v^2/r \quad (5)$$

wherein $F_m$ is the magnetic force, $F_g$ is the gravitational force, $F_s$ is the hydrodynamic force in the region of laminar flow according to Stokes' Law, and $F_n$ is the force of hydrodynamic resistance in the region of turbulent flow according to the equation of Newton-Rittinger, and further wherein $I_f$ = magnetic intensity of the fluid medium in Teslas.

$\nabla H$ = gradient of the magnetic field in amperes per square meter.

$P_o$ = density of the particle $P_f$ = density of the fluid medium $g$ = the gravitational acceleration, i.e., 9.8 meters per second per second.

$n$ = the viscosity of the magnetic fluid in kg $m^{-1}$ $sec^{-1}$ $r$ = the particle radius in meters $v$ = velocity of the particle in meters per second
$Q$ = coefficient of resistance (ideally unity, but found to be 0.4 for a turbulent flow region)

For gravity, F/V is scale independent. Only the densities of the object and of the fluid are involved. The F/V for flow resistance varies as $1/r^2$ (Stokes) or $1/r$ (Newton-Rittinger). Either the values of F/V are large or the velocity, $v$, is small. It is required to move the particle a fixed distance, then the time needed will increase as the particle size decreases.

For non-magnetic solid particles, the magnetic F/V is independent of the particle properties; all particles are affected the same way. The scaling of the magnetic F/V depends entirely on the gradient $\nabla$ H. This field gradient is created in the fluid in the gap between the poles of the magnet. The magnitude of the gradient depends on the size of the gap, the shape of the pole pieces and the magnitude of the field, H. In general, the maximum gradient varies as the central field divided by the gap length ($H_o/L_g$). However, the central field, $H_o$, varies as the magnetomotive force divided by gap length ($mmf/L_g$). Therefore, the magnetic F/V that can be created is strongly dependent on the gap length of the magnet. If the gap length is large, it is difficult to generate a high value of the gradient. Conversely, it is easy to generate very high values of $\nabla$ H in a small gap.

In view of the foregoing, it becomes apparent that in the single-gap type separators the separation volume is limited by the magnet size and the field gradient required, and since $H \alpha H/L \alpha mmf/L^2$, the magnetomotive force must increase with the square of the gap length in order to maintain a constant $\nabla$ H. A maximum practical gap separation is about 0.2 meters. This means that the separation volume of a single-gap apparatus cannot be scaled up easily and instead an increase in capacity is achieved only by the use of multiple separators with correspondingly high investment costs. Moreover, the distance the particles must travel through the magnetic fluid are relatively large, making processing times unduly long and to a degree limiting the minimum particle size that can be separated.

In marked contrast, scale up in the case of a multiple-gap separator of the present invention is readily accomplished. Since the gaps are created by multiple magnetic poles separated by relatively small distances, the generation of the required magnetic field is simpler than with a single large gap apparatus, and also the grid can be extended essentially to an unlimited degree laterally and/or longitudinally by merely using a greater number of poles and extending the length of the grid structure, respectively. Also since the critical point of the field is quite close to the surface of the grid, only a very shallow body of magnetic fluid need be present over the grid to carry out the separation process. This is especially important where mixtures of fine particles are being treated, since the length of travel required by each particle is quite small and thus processing time is also short. The minimum particle size is in fact controlled by wetting the surface effects rather than to factors inherent in the magnetic levitation procedure. Further, since the lateral and longitudinal forces in the magnetic fluid are found to be negligible above the critical point, it is possible to move particles laterally in any direction without change in the forces, thereby making it feasible to flow low density particles across the grid with the magnetic fluid without much variation due to the grid structure. It is also significant that the vertical force contours are not very dependent on the exact pole shape in the grid structure. Very simple structures can be used and specially shaped poles are not required.

The structure of the apparatus for separating substantially non-magnetic particles of different density comprises in general a. a magnetic fluid comprising a colloidal suspension of superparamagnetic material in a liquid medium;

b. means for generating in said magnetic fluid a gradient having a vertical component in the direction opposite to gravity, said vertical component having critical points below which the contours of constant force thereof are discontinuous and above which said contours of constant force are continuous;

c. means for introducing into said magnetic fluid at a level not lower than said critical points a mixture of at least two solid non-magnetic particles having densities which are different and greater than the actual density of the magnetic fluid; and d. means for recovering at least one of the said particles from said magnetic fluid.

The means used to generate the particular magnetic field required in the apparatus of this invention can be any of a number of grid-type structures which have certain structural features in common. In preferred embodiments the grids which are the sources of the magnetic force comprise a plurality of elongated members which emit magnetomotive force, at least three of said members immediately adjacent to each other being spaced apart, having their linear axes in a generally parallel configuration and being essentially in a common plane, the polarity of the magnetic field contributed by the middle member of the three being opposite to that of the other two members adjacent thereto and said three members being in sufficient proximity to each other that the magnetic field contributed by the middle member interacts with the magnetic field contributed by the other two members. The magnetomotive force can be produced by permanent magnets, electromagnets or conductors carrying an electrical current. More than one source type can be suitably employed if desired.

One embodiment in which the magnetic force is derived from permanent magnets is shown in FIG. 1*a* and FIG. 1*b* of the drawings. With reference to the figures a grid is formed from nine iron poles, one of which is indicated by reference number 10. The iron poles transmit the magnetomotive force produced by sixteen ferrite magnets, one of which is indicated by reference number 12, which alternate with the iron poles and define the width of the open spaces in the central area of the grid denoted generally by reference letter "*a*". In central are "*a*" the iron poles are octagonal and are reduced in cross-section, section, the diameter of which preferably approximates the spacial distance between the iron poles. The octagonal cross-section and other configurations which are generally round or eliptical and avoid the presence of sharp angular surfaces are preferred.

In FIG. 2 the grid of FIG. 1*a* is shown in combination with means to separate particles by magnetic levitation and collect the separated fractions. Grid 20 is situated in a tilted position in tank 21 which contains a magnetic liquid medium, the surface of which is indicated by reference number 22. A mixture of particles 23 is fed into the magnetic liquid via chute 24 above the critical point of the magnetic field generated by the grid 20. Particles which have a density less than the apparent density of the magnetic fluid at the critical point are levitated by the system and move under the force of gravity downward across the surface of the grid 20 and are collected in bin 25. Particles which have densities greater than the apparent density of the magnetic liquid at the critical points pass through the plane of the critical points and downward through the spaces in the grid into bin 26.

For the separation of very small particles, a grid constructed of an electrical conductor carrying a direct current can be advantageously employed. The magnetic field generated by the current flow through the conductor can be quite strong even though the conductor is of very small diameter and the gaps therebetween equally small. In practice the magnetic fluid over the grid can be very shallow, thereby greatly decreasing the distances the particles must move to accomplish a separation on the basis of particle density.

A grid formed from an electrical conductor is shown in FIG. 3. Conductor 30 is formed of any good conducting material such as copper and is formed into a plurality of elongated U-shaped sections such that the overall configuration is an array of linear conductor segments parallel to each other and essentially in the same plane. The arrows on each segment indicates the direction of the direct current passed therethrough, which creates flux lines surrounding each segment which is opposite to those of each immediately adjacent segment. The magnetic field contribution of each segment also interacts with that contributed by each other immediately adjacent segment.

The character of the magnetic field above a wire grid such as shown in FIG. 3, i.e., the field intensity and direction at any point in a magnetic fluid immediately adjacent to or in which the grid is immersed, can be computed using Ampere's law to determine the contribution from each wire and forming the vector sum. A computer program can be formulated to accomplish these computations and used to print out values of the field intensity, the vertical component of the field gradient, and the horizontal component of the field gradient at various positions in the vicinity of the wires of a grid such as that of FIG. 3. In FIG. 4, a contour map of the vertical component of the gradient for five adjacent wire segments of the grid of FIG. 3 is shown. The plane containing the critical points intersects the plane of the drawing at right angles and passes through line b—b. The continuous nature of the contours above the critical point is readily apparent from the drawing.

In FIG. 5 is shown a similar contour map of the vertical component of the gradient generated by octogonal prism poles such as are shown in the grid of FIG. 1*b*. In FIG. 5 one quadrant of an octagonal pole is shown at the lower right corner of the map. The critical point is noted at the left side of the map. Here again the discontinuous and continuous contours above and below the critical point are clearly evident.

In separating solid objects in magnetic fluids, the direction each object moves depends on its density relative to the apparent density, $P_a$ of the magnetic fluid resulting from the magnetic field induced therein, and which is dependent on the vertical component of the gradient, $\nabla H_z$. In attempting to achieve an essentially constant apparent density value for the separating zone of magnetic fluids, it has heretofore been the approach in the prior art to design a magnet that would generate a field in magnetic fluids which has a nearly constant gradient over as much of the separation zone as possible. In this regard the present invention is directed in a contrary manner, i.e., there is no attempt made whatever to generate in the separating fluid any substantial volume of fluid having a nearly constant gradient. This is readily apparent from the apparent density profile shown in FIG. 6. Although this profile can be altered somewhat by shaping the pole pieces of the grids of this invention, the general features of the curve are the same for all of the multigap grids. In FIG. 6 the apparent density, $P_a$, is plotted against the vertical height, Z, above the grid in the magnetic fluid and on a central plane of a gap. The curve is drawn with Z as the ordinate since it represents the vertical direction in real space, and p as the abscissa. The actual density of the magnetic fluid is indicated by line $p_f$ and is essentially constant in the volume of fluid here involved. The point of maximum apparent density in the fluid created by the grid is indicated at point $p_c$ on the abscissa. It is readily apparent that only a very small volume of the fluid exhibits this "critical point" density.

It is not essential that the grid structures of the present invention contain open spaces between the elongated grid elements. When it is desired that dense particles separated from a mixture of particles not be permitted to pass through the grid for collection, the gaps can be closed with any material which does not substantially alter the fundamental nature of the typical magnetic field generated by a grid in which the grid members contain open spaces. For example, closed grids which comprise alternating permanent magnets, as generators of the megnetomotive force, and soft iron transmitters of that force are found to function in essentially the same manner as the open grid of FIG. 1*a*. Also, nonmagnetic substances such as plastics and aluminum can readily be used to fill in the spaces of the grid of FIG. 1*a* without altering its inherent nature. These closed or "table" grids conveniently can serve not only as the source of the magnetic field used in the separating procedure but can also serve as a surface to collect the dense fraction of particles of the mixture being separated.

The particular magnetic liquid medium employed in the practice of the present invention is not a critical factor. A variety of these compositions and the method for their preparation have been proposed in the prior art. S. S. Papell in U.S. Pat. No. 3,215,572 of Nov. 2, 1965 has disclosed a propellant containing magnetic particles. Papell also described colloidal magnetic fluids with O. C. Faber in NASA report TN D-4676 of Aug. 1968. U.S. patents dealing with magnetic fluids are Rosensweig, U.S. Pat. No. 3,531,413 of Sept. 29, 1970, on the substitution of one solvent for another, and Reimers and Khalafalla U.S. application, Ser. No. 275,382, on preparation by peptization. Other publications on the properties of magnetic fluids are NASA report CR-1407 of 1969 by R. Kaiser and an article in the Journal of Applied Physics 41, 1064 (1970) by R. Kaiser and G. Miskolczy.

The magnetic fluids used in this invention can range in intensity of magnetization from 1 to 1000 gauss ($10^{-4}$ to 0.1 tesla), but values of 100–500 gauss (0.01–0.05 tesla) are preferred. The gradient of the magnetic field could be as large as perhaps 200,000 oersteds/cm ($1.59 \times 10^9$ amp./m$^2$) near a sharp corner of a magnet or a thin magnetized wire, but a range of 100–200 oersteds/cm ($8 \times 10^5$ to $15 \times 10^5$ amp/m$^2$) is preferred.

The particle mixture which is separated into at least two components on the basis of density according to the present process must of course contain particles of two densities, and preferably the density values should differ by at least 1.0 g./cm³. More preferably, the densities should differ by at least 3.0 g./cm³.

The chemical nature of the particles is not a critical factor, provided of course they are not reactive in the chemical sense with the magnetic fluid employed or with each other under the conditions of the separation. A variety of magnetic fluid media are available which are highly inert and hence suitable selection of a magnetic fluid vis-a-vis the particle mixture can obviate any problem in this regard should it arise.

To process a raw material by the present process in the most efficaceous manner it is desirable in some instances to pretreat the starting mass in one or more ways. For example, if the raw material is wet with water or other liquids which tend to interfere with the properties of the magnetic fluid, the removal of such liquids is advisable. Depending on its initial conditions, it may be desirable or necessary to crush the feed material into granular form small enough to liberate the phases of different density. Frequently, granulation to particles of about 25 mm or less is required for this purpose. It can also be advantageous to carry out a sizing step, usually employing screens or sieves. In the separation process it is further advantageous to treat sized fractions separately, because exposing samples of discordant sizes to the ferromagnetic separating apparatus at the same time may prevent equal exposure of each particle or granule to the levitating process. Larger pieces can carry along adhering smaller pieces of different density. Therefore, it is preferred practice to treat materials within a maximum diameter ratio of 5 to 1, preferably 3 to 1, and if possible, 2 to 1, at the same time.

It is also highly desirable as a pre-treatment step to remove all strongly magnetic particles with a permanent magnet before exposing the sample to ferromagnetic levitation, because magnetic particles will stick to the electromagnets or permanent magnets of the magnetic grid eventually causing partial blockage or sludging in the apparatus. This can be accomplished on a commercial scale by conventional magnetic separators for removing tramp iron. Weakly diamagnetic or weakly paramagnetic materials such as organic plastics, metals, metal oxides and the like are considered to be non-magnetic for purposes of defining and claiming the processes and apparatus of the present invention.

The invention is illustrated by the following example:

EXAMPLE

A permanent magnet array as shown in FIG. 2 was constructed utilizing a frame 12 inches long and 6¼ inches wide. Twenty-four ceramic type 1 magnets two-inches square were used, twelve at each end, separated by 13 soft iron bars running the length of the apparatus. This array was fitted in a covered supporting tray 16 inches by 9¼ inches filled with about 3.5 liters of magnet fluid. A mixture of 375 grams of crushed tantalum-/epoxy granules, less than 35 mesh (0.5 mm), from the manufacture of electronic components, was fed at the rate of about six grams per minute through feed means 24 onto about a one-centimeter layer of 200 gauss magnetic fluid covering the array which is immersed in about five centimeters of fluid. The levitated epoxy of material, which was unable to pass through the critical point of the apparent density of the fluid was collected in bin 25. The heavier metallic particles fell through the multiplicity of gaps within seconds. At the termination of the process, end of the experiment, 80 grams (27%) of the light plastic fraction had been collected, 286 grams (76%) of metallic granules were collected, and 9 grams (2%) of material was either lost or stuck to the permanent magnets, because it was itself magnetic. Heretofore such a separation was carried out by acidic leaching.

What is claimed is:

1. Process for separating non-magnetic particles on the basis of their different densities which comprises providing a magnetic fluid comprising a colloidal suspension of superparamagnetic material in a liquid medium; generating in said magnetic fluid a non-uniform magnetic field gradient, said gradient producing in said magnetic fluid a vertical force component in the direction opposite to gravity, said vertical force component decreasing in magnitude in the direction opposite to gravity and having critical points below which the contours of constant force thereof are discontinuous and above which said contours of constant force are continuous; introducing into said magnetic fluid having the said non-uniform magnetic field gradient generated therein a mixture of at least two solid non-magnetic particles having densities which are different and greater than the actual density of the magnetic fluid, the level of introduction of said particle mixture being not lower than the said critical points in said fluid, whereby the particles segregate themselves in different zones of said magnetic fluid; and recovering at least some of the thus segregated particles.

2. Process according to claim 1 wherein the non-uniform magnetic field gradient in the magnetic fluid is generated by a grid of magnetic generators which comprises a plurality of elongated members which emit magnetomotive force, at least three of said members immediately adjacent to each other being spaced apart, having their linear axes in a generally parallel configuration and being essentially in a common plane, the polarity of the magnetic field contributed by the middle member of the three being opposite to that of the other two said members adjacent thereto and said three members being in sufficient proximity to each other that the magnetic field contributed by the middle member interacts with the magnetic field contributed by the other two members.

3. Process according to claim 2 wherein the density of the non-magnetic particles of the mixture is such that at least one is less and at least one is greater than the apparent density of the magnetic fluid at the critical point of the gradient generated therein, the particles being separated by virtue of the more dense particle passing downward through the magnetic fluid to a point below the critical point and the less dense particle remaining levitated in said magnetic fluid at a point above the critical point.

4. Process according to claim 2 wherein the contours of constant force of the vertical component of the non-uniform magnetic field gradient are finite and less than the total gradient which is generated in an upward direction normal to the surface of the grid.

5. Process according to claim 1 wherein the mixture of non-magnetic particles contains at least two such particles whose densities differ by at least 1 gram per cubic centimeter.

6. Apparatus for separating particles on the basis of their density which comprises a magnetic fluid comprising a colloidal suspension of superparamagnetic material in a liquid medium; means for generating in said magnetic fluid a non-uniform mangetic field gradient, said gradient producing in said magnetic fluid a vertical force component in the direction opposite to gravity, said vertical force component decreasing in magnitude in the direction opposite to gravity and having critical points below which the contours of constant force thereof are discontinuous and above which said contours of constant force are continuous; means for introducing into said magnetic fluid a mixture of at least two solid non-magnetic particles having densities which are different and greater than the actual density of the magnetic fluid, the level of introduction of said particle mixture being not lower than the said critical points in said fluid; and means for recovering at least some of the segregated particles.

7. Apparatus according to claim 6 wherein the means for generating the non-uniform magnetic field gradient is a grid of magnetic generators which comprises a plurality of elongated members which emit magnetomotive force, at least three of said members immediately adjacent to each other being spaced apart, having their linear axes in a generally parallel configuration and being essentially in a common plane, the polarity of the magnetic field contributed by the middle member of the three being opposite to that of the other two said members adjacent thereto and said three members being in sufficient proximity to each other that the magnetic field contributed by the middle member interacts with the magnetic field contributed by the other two members.

8. Apparatus according to claim 7 wherein the grid is comprised of members which produce magnetomotive force which is generated by permanent magnets.

9. Apparatus according to claim 7 wherein the grid is comprised of members which produce magnetomotive force which is generated by electromagnets.

10. Apparatus according to claim 7 wherein the members producing magnetomotive force are conductors carrying electric current.

* * * * *